US007916891B2

(12) United States Patent
Zhou et al.

(10) Patent No.: US 7,916,891 B2
(45) Date of Patent: Mar. 29, 2011

(54) APPARATUS FOR MEASUREMENT OF FLOATING BODY POSTURE OF PERSON WEARING LIFE JACKET

(75) Inventors: Hong Zhou, Beijing (CN); Meiwu Shi, Beijing (CN); Hong Xiao, Beijing (CN); Fei Duan, Beijing (CN); Shiliang Dai, Beijing (CN); Jinyu Zhu, Beijing (CN)

(73) Assignee: The Soldier System Research Center of the Quartermaster Research Institute of the General Logistics Department of the CPLA, Beijing (CN)

( * ) Notice: Subject to any disclaimer, the term of this patent is extended or adjusted under 35 U.S.C. 154(b) by 921 days.

(21) Appl. No.: 11/779,949

(22) Filed: Jul. 19, 2007

(65) Prior Publication Data

US 2008/0019570 A1 Jan. 24, 2008

(30) Foreign Application Priority Data

Jul. 19, 2006 (CN) ..... 2006 1 0088838

(51) Int. Cl.
*G06K 9/00* (2006.01)

(52) U.S. Cl. ..... 382/100; 382/154; 382/111; 382/103; 441/88

(58) Field of Classification Search ..... 382/100, 382/154, 111; 441/80–88
See application file for complete search history.

(56) References Cited

U.S. PATENT DOCUMENTS 7,627,139 B2 * 12/2009 Marks et al. ..... 382/103
2004/0120774 A1 * 6/2004 Courtney et al. ..... 405/185

* cited by examiner

*Primary Examiner* — Vu Le
*Assistant Examiner* — Claire Wang
(74) *Attorney, Agent, or Firm* — Matthias Scholl P.C.; Matthias Scholl

(57) ABSTRACT

Taught herein is an apparatus for measurement of floating body posture of a person wearing a life jacket, comprising a backpack frame having a plurality of reference points, an image collecting system, and an image processing system; wherein the image collecting system collects image sequence information of the person wearing the life jacket via the reference points; the image processing system processes the image sequence information, so as to obtain the dynamics of a movement of the person and the quasi-static parameters of such movement. The system is capable of reflecting the dynamics of a movement of a body in water and the quasi-static parameters thereof.

13 Claims, 5 Drawing Sheets

APPARATUS FOR MEASUREMENT OF FLOATING BODY POSTURE OF PERSON WEARING LIFE JACKET

CROSS-REFERENCE TO RELATED APPLICATIONS

This application claims priority to Chinese Patent Application No. 200610088838.6 filed on Jul. 19, 2006, the contents of which are incorporated herein by reference.

BACKGROUND OF THE INVENTION

1. Field of the Invention

The invention relates to an apparatus for measurement of posture, and particularly to an apparatus for measurement of floating body posture of a person wearing a life jacket.

2. Description of the Related Art

Posture of a person wearing a life jacket in water is an important factor in evaluating performance of a life jacket, and how to accurately obtain various posture parameters is of great importance for the evaluation. Conventionally, posture parameters of a person wearing a life jacket in water are obtained by expert evaluation and static testing. Safety standards of various countries define that when a person wearing a life jacket is in a balance state, the distance between the person's mouth and the water surface is measured first, the overturn time of the person is calculated using a stopwatch, and then a float angle is obtained via a protractor. However, this method is too simplistic to accurately reflect the dynamics of a movement of the person's body in water and the quasi-static parameters associated therewith.

SUMMARY OF THE INVENTION

In view of the above-described problems, it is one objective of the invention to provide a system that is capable of reflecting a movement of a person's body wearing a life jacket in water and the quasi-static parameters thereof.

To achieve the above objectives, one embodiment of the invention provides an apparatus for measurement of floating body posture of a person wearing a life jacket, comprising a backpack frame having a plurality of reference points, an image collecting system, and an image processing system; wherein the image collecting system collects image sequence information of the person wearing a life jacket from the reference points; the image processing system processes the image sequence information, so as to obtain a dynamics of a movement of the person and the quasi-static parameters associated therewith.

In certain classes of this embodiment, the image collecting system comprises a pair of cameras, and a pair of image collecting cards connected to the cameras via a pair of data lines.

In certain classes of this embodiment, the backpack frame is located in an overlapping view field of the cameras.

In certain classes of this embodiment, the image processing system comprises software for performing image processing and a computer (incl. CPU).

In certain classes of this embodiment, the backpack frame comprises a plurality of bellows, a plurality of supporting plates, a plurality of reference points, a shoulder armor plate, a plurality of aluminum pipes, a haunch armor plate, a plurality of steel bars, a plurality of rivets, a waistband, a plurality of welding spot, a first connector and a second connector.

In certain classes of this embodiment, the bellows are jointly connected to the aluminum pipes via the shoulder armor plate.

In certain classes of this embodiment, the haunch armor plate is connected to the steel bar via the rivet.

In certain classes of this embodiment, the aluminum pipe is connected to the bellows via the first connector.

In certain classes of this embodiment, the aluminum pipe is connected to the supporting plates and the reference point via the second connector.

In certain classes of this embodiment, a surface of the supporting plate is coated with one or more low-reflectivity materials.

In certain classes of this embodiment, the supporting plate is fixed to the first connector via a screw thread.

In certain classes of this embodiment, the reference point is fixed to the first connector with glue.

In certain classes of this embodiment, the shoulder armor plate operates to fix the backpack frame to a shoulder of the person wearing the life jacket.

Compared with prior art, the invention has the following advantages: (1) The backpack frame features strong and flexible characteristics, high rigidity, small weight, convenient and reliable connection, compatibility with various devices, adaptability to different postures, along with no effects on movement of a person in water, which meet the testing requirements and enhance flexibility; (2) An image recognition algorithm of the reference point makes it possible to accurately locate the center of a circle even if the reference point is partly shaded, which greatly improves reliability of the system. The supporting plate coated with low-reflectivity materials is disposed at the bottom of the reference point, and helps to overcome the light reflection effect in a complex circumstance, which bring great convenience and reliability for object recognition; (3) The body movement posture in water is optically measured via reference points in a non-contacting manner, which transforms the body posture into a spacial position of a reference point. In this way, an expected dynamic movement of any time duration can be obtained, and the limitation of manual sampling is overcome; (4) A fast and precise circular object recognition algorithm based on a reference point recognition algorithm and a curvature scale-space technique is provided; (5) The precision of the circular object recognition algorithm is higher than that of a classical Hough transform, and it is more reliable than a block-based processing and recognition algorithm. The circular object robust recognition algorithm overcomes problems caused by shading of the reference point and a complex background, and reduces time spent on calculation.

BRIEF DESCRIPTION OF THE DRAWINGS

The invention is described hereinafter with reference to accompanying drawings, in which.

DETAILED DESCRIPTION OF THE INVENTION

Figure 1:
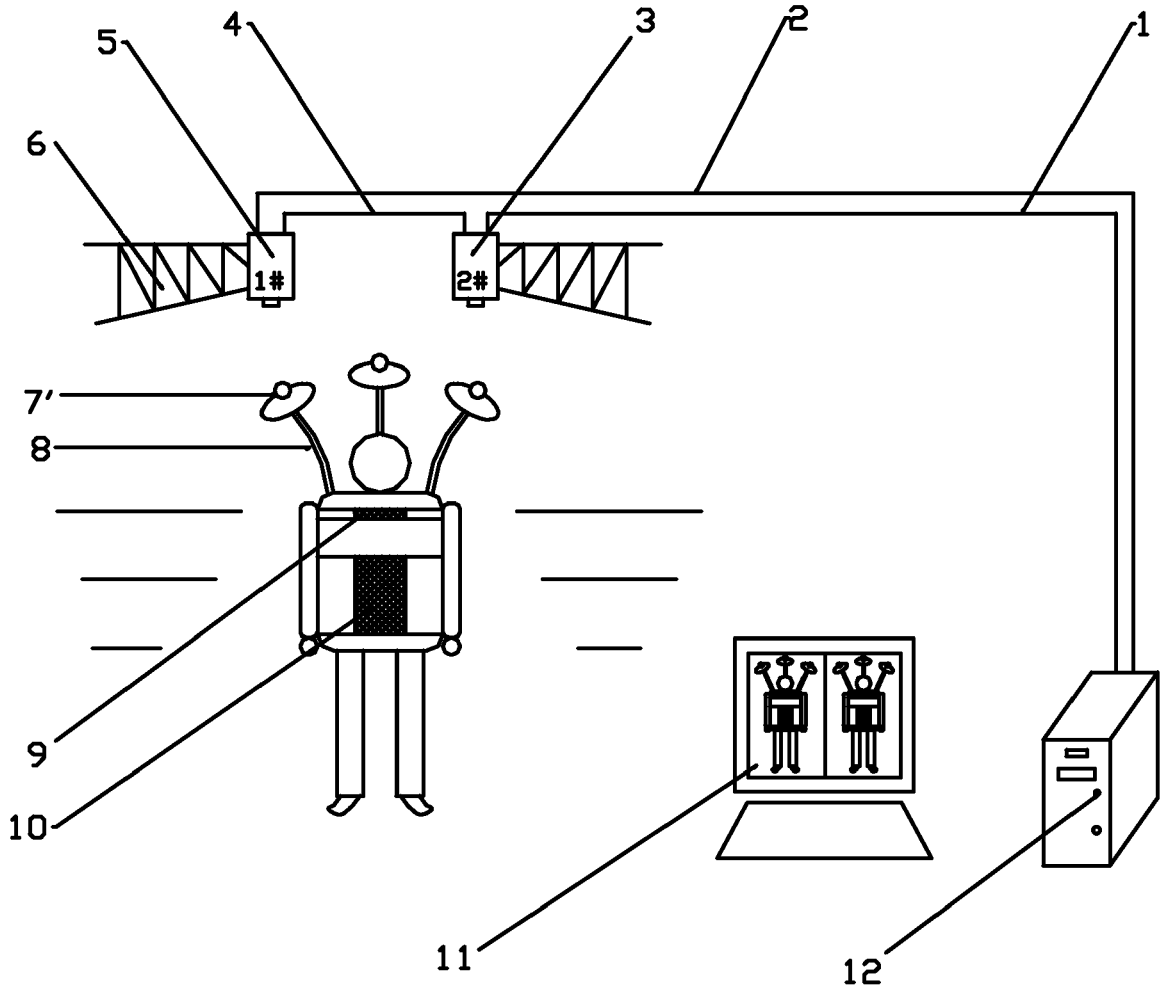
FIG. 1 is a schematic diagram of an apparatus for measurement of floating body posture of a person wearing a life jacket according to one embodiment of the invention.

As shown in FIG. 1, an apparatus for measurement of floating body posture of a person wearing a life jacket comprises a first camera 5, a second camera 3, a first data line 2, a second data line 1, a synchronization control line 4, a bracket 6, a backpack frame 7 with a reference point 7', a support pipe 8, a shoulder strap 9, a waistband 10, a display 11, and a host computer 12. The bracket 6 is located at the edge of a water pool. The display 11 and the host computer 12 are located on one side of the bracket 6. The cameras 3 and 5 are fixed on the bracket 6. The bracket 6 may move in two coordinate planes. A pitching angle and a fling angle of each of the cameras 3 and 5 can be adjusted. The cameras 3 and 5 are connected to a pair of OK_C30S image collecting cards in the host computer 12 via the data lines 1 and 2. The cameras 3 and 5 are adjusted to face downward the water surface, so that an overlapping view field therebetween is a movement region of a person wearing a life jacket in the water. External synchronization trigger ports of the cameras 3 and 5 are connected to each other via the synchronization control line 4 to ensure synchronous data collection. It is required that the person wearing life jacket put the backpack frame 7 on his/her back via the shoulder strap 9 and the waistband 10 before getting into water, and it should be ensured that the reference point 7' on the backpack frame 7 is located in the overlapping view field of the cameras 3 and 5 after the person gets into water. The cameras 3 and 5 should be adjusted based on a function of "double card synchronous real-time display" for collecting software run on the computer display 11. A human-computer interaction is processed by an image collecting program in a sampling mode designated by a user, the sampling mode comprising selecting different collecting objects (i.e. memory, hard disk), sample time, sample frequencies and so on.

Figure 7:
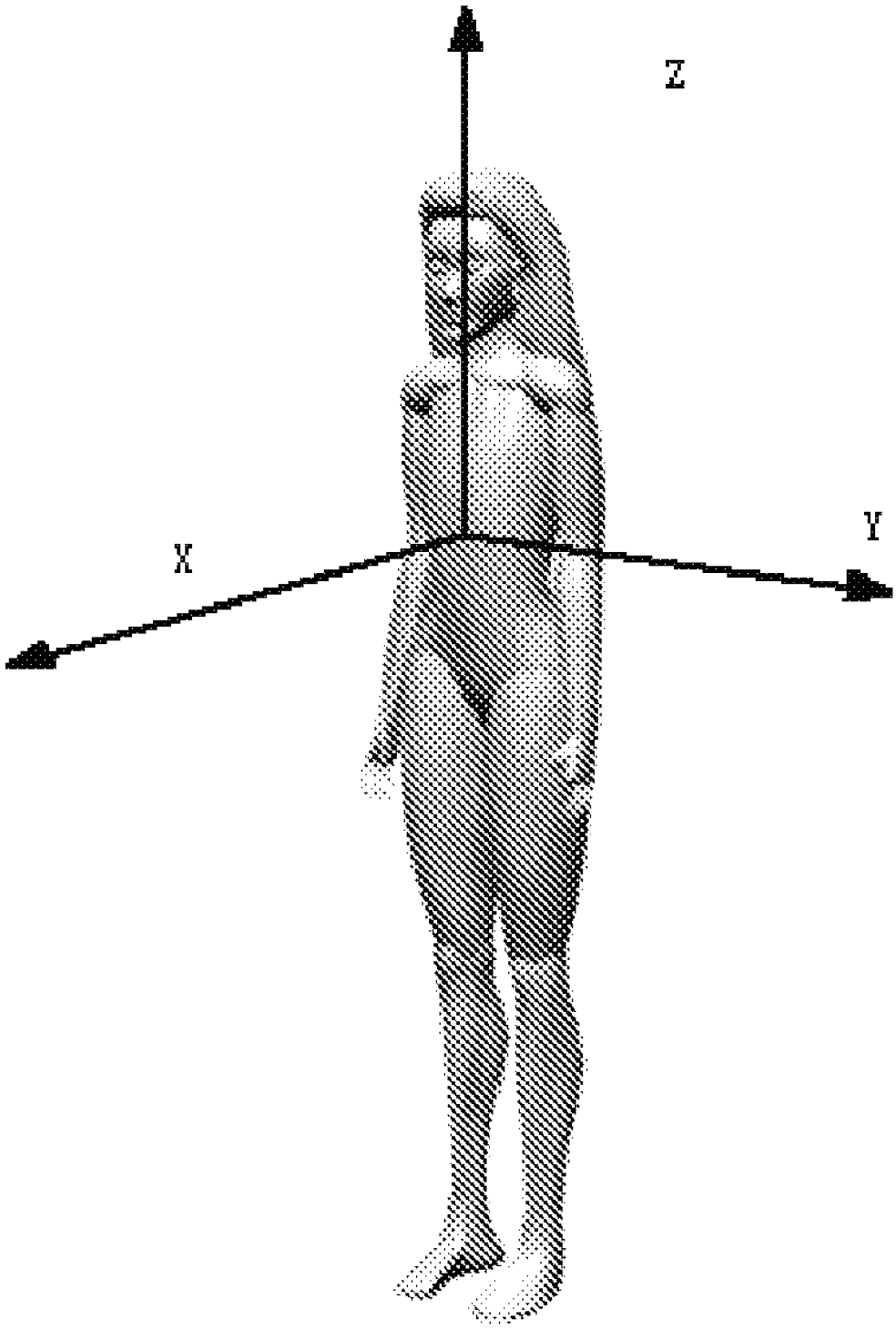
FIG. 7 is a schematic diagram of body coordinates used in calculations according to one embodiment of the invention.

To obtain a relationship between a two-dimensional plane coordinate of the reference point on the backpack frame 7 and a three-dimension space coordinate thereof, the cameras 3 and 5 need to be calibrated, which comprises collecting moving sequence images on a calibration plate as shown in FIG. 7 by the cameras; then processing the moving sequence images according to a calibration program guideline of the cameras to obtain parameters of the cameras; and finally saving the parameters to a data file for further calculation.

Figure 2:
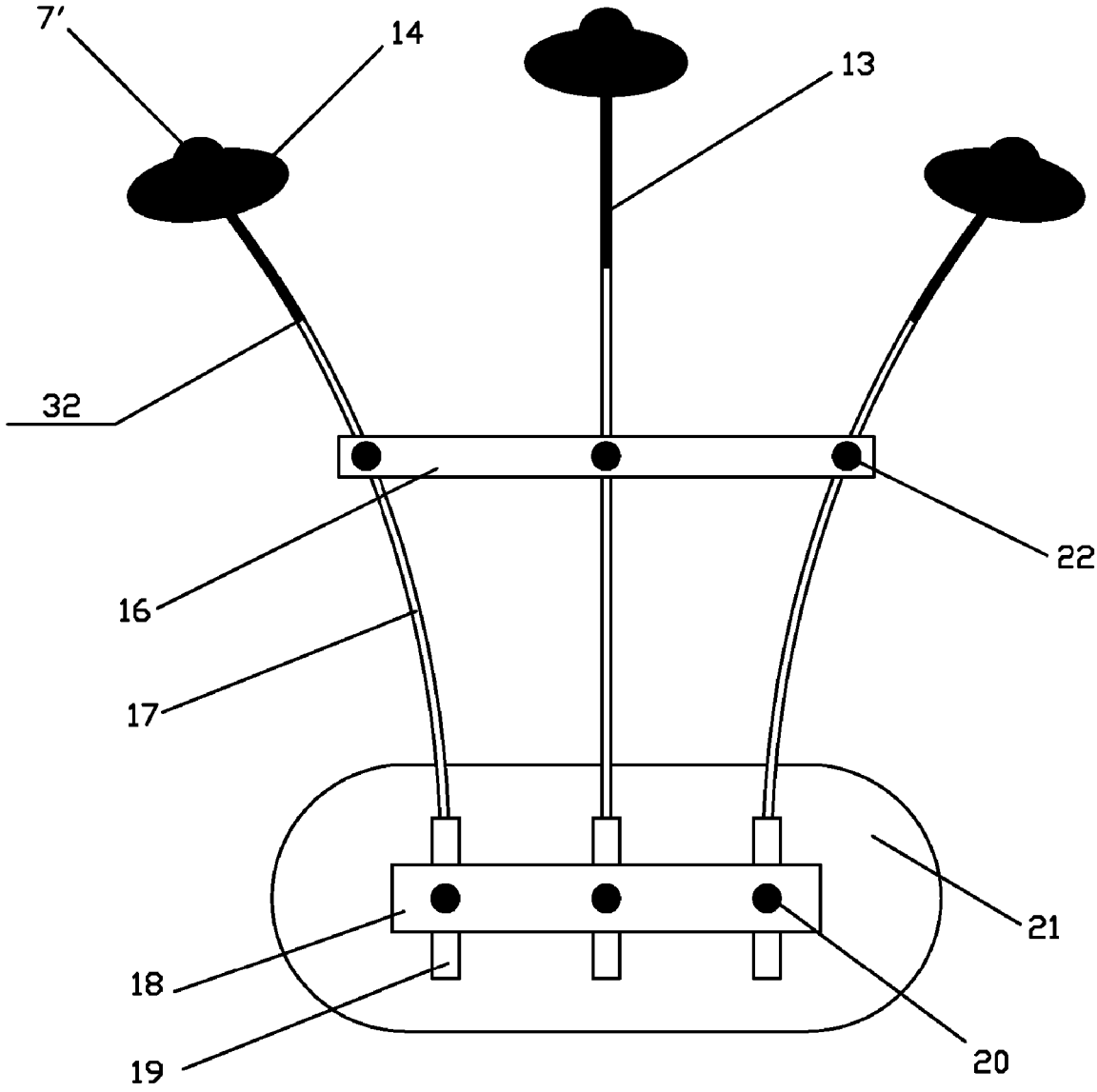
FIG. 2 is a schematic diagram of a backpack frame according to one embodiment of the invention.

As shown in FIG. 2, a backpack frame 7 comprises a plurality of bellows 13, a plurality of supporting plates 14, a plurality of reference points 7', a shoulder armor plate 16, a plurality of aluminum pipes 17, a haunch armor plate 18, a plurality of steel bars 19, a plurality of rivets 20, a waistband 21, a plurality of welding spots 22 and a plurality of connectors 32.

The bellows 13 are jointly connected to the aluminum pipes 17 via the shoulder armor plate 16, and the haunch armor plate 18 is connected to the steel bars 19 via the rivets 20. The aluminum pipe 17 is connected to the bellows 13 via the connector 32, and to the supporting plates 14 and the reference point 7' via the connector 32 with a length of about 20 cm. A surface of the supporting plate 14 is coated with low-reflectivity materials, and the supporting plate 14 is fixed to the connector 31 via a screw thread. The reference point 29 is a standard ping pong ball, and is fixed to the connector 31 with glue. The shoulder armor plate 16 operates to fix the backpack frame to a shoulder of the person wearing the life jacket.

Figure 3:
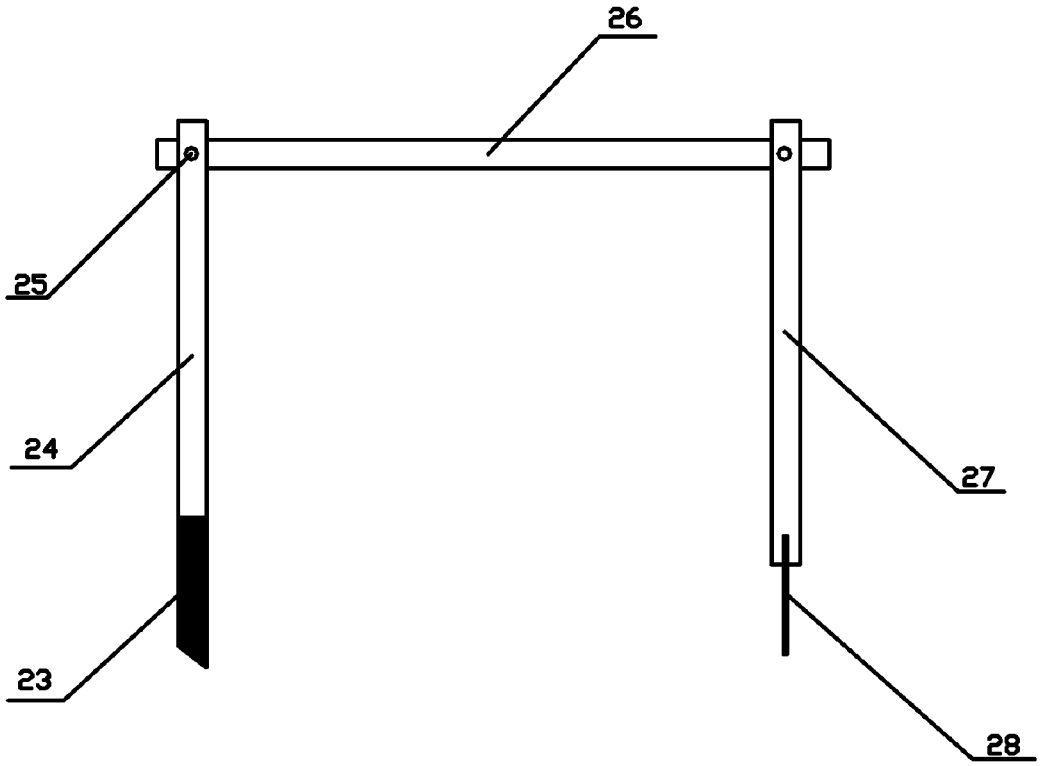
FIG. 3 is a schematic diagram of a testing gauge according to one embodiment of the invention.

As shown in FIG. 3, a testing gauge of the invention measures distances between the reference points and a mouth of the person wearing the life jacket. A lower end of the pole 24 is interference fit with a glass post 23 of 5 cm in length. A portion of the pole 24 within a range of 3 cm away from the top thereof is rolled flat and drilled, and then connected to a left part of a pole 26 which is rolled flat via a plurality of bolts and nuts. A groove with a length of 3 cm and a width of 1.5 cm is disposed at a lower part of the pole 27, so as to receive a rectangular aluminum board 28 with a thickness of 1.5 mm. The groove is interference fit with the aluminum board 28. A portion of the pole 27 within a range of 3 cm away from the top thereof is rolled flat and drilled, and then connected to the pole 26 via a plurality of bolts and nuts. In this way, by adjusting an angle among the poles 24, 27 and 26, the organic glass post may abut against the mouth and the aluminum board 28 may be tangent with the reference point 7'. Then, nuts on both sides of the poles 24 and 27 are fastened, so that the angle among the poles 24, 27 and 26 is fixed. Finally, the bracket is removed, a distance between the lower part of the organic glass post 23 and the aluminum board 28 is measured, and the distance between the reference point 7' and the mouth is determined.

Figure 4:
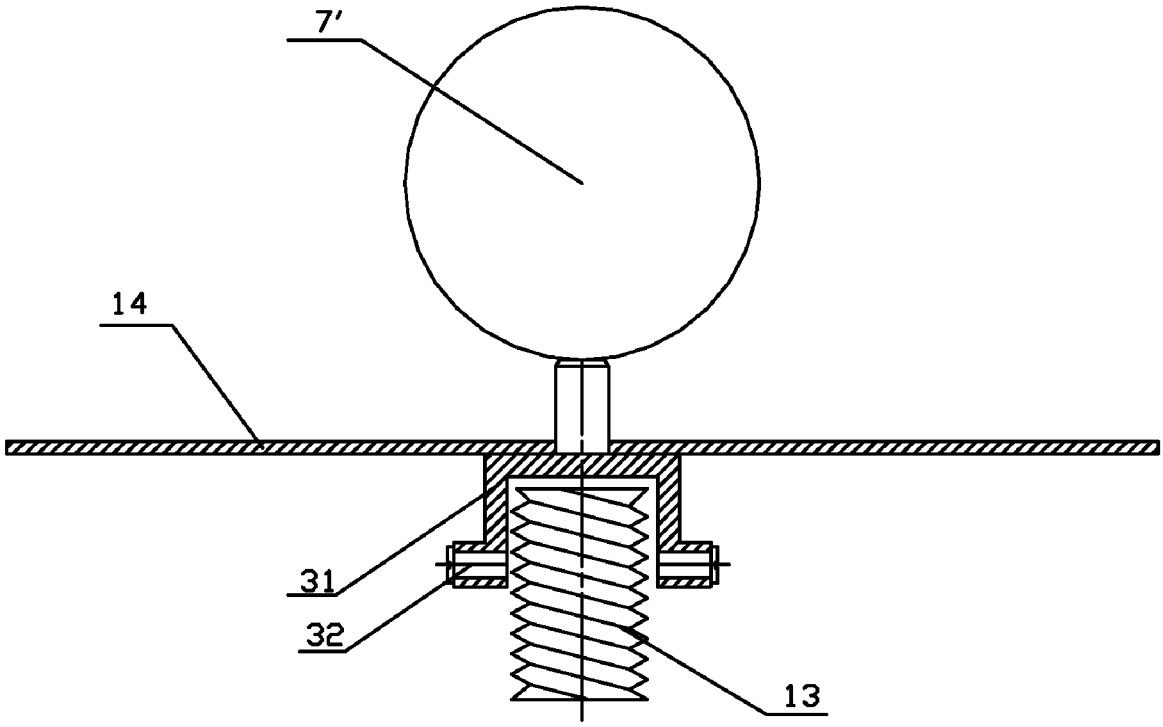
FIG. 4 illustrates a diagram for connecting a bellows with a connector according to one embodiment of the invention.
Figure 5:
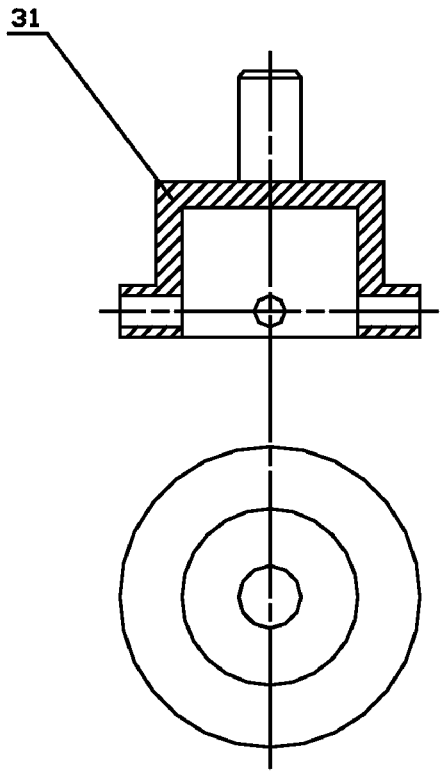
FIG. 5 is a cross-sectional view of a connector according to one embodiment of the invention.
Figure 6:
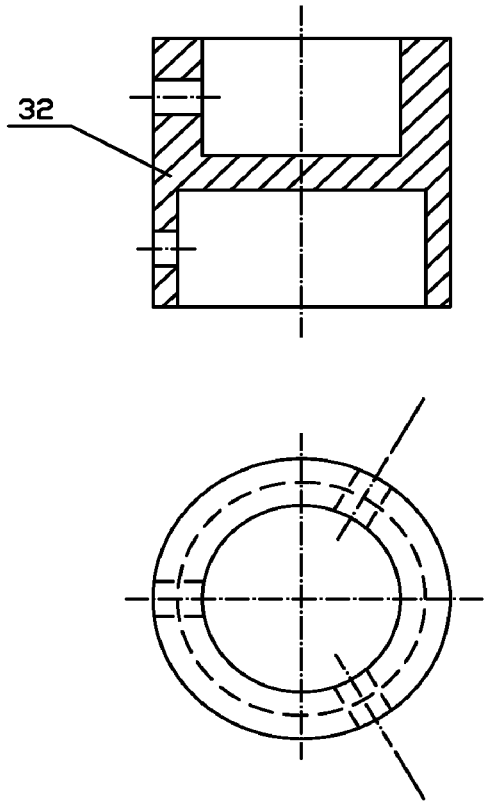
FIG. 6 is a cross-sectional view of a connector according to another embodiment of the invention.

As shown in FIG. 4, the radius of the supporting plate 14 is 8 cm, a center of the supporting plate 14 is drilled and tapped, and then the supporting plate 14 is connected to the connector 31 via a screw thread, and the reference 7' is fixedly connected with glue to a bolt at the top of the connector 31. As the bellows 13 are inset into the connector 31, the bellows 33 are fixed via four bolts uniformly distributed at the bottom of the connector 31.

As shown in FIG. 7, it is defined that the chest-back axis is the X direction, the left-right axis is the Y direction, the head-haunch axis is the Z direction, the three reference point planes on the top of the backpack frame constitute an X-Y plane of the backpack frame coordinate system, and a normal of the X-Y plane is the Z direction of the backpack frame coordinate system. Because a transformation matrix between the backpack frame coordinate system and the body coordinate system does not change with a movement of the body, the position of every coordinate of the backpack frame coordinate system can be obtained from the reference points indirectly, and a space position can be obtained from the transformation. If the collected image is a time sequence, the dynamic movement of the body posture with time is determined, and reliable data for evaluating floating performance of a life jacket are obtained by analyzing static values of the body posture.

The process of measuring of floating body posture of a person wearing a life jacket comprises: starting the computer and powering on the cameras; activating the image collecting software; selecting the option "two way real-time display"; adjusting the cameras to appropriate positions as described above, and determining a testing region; implementing software-assisted image collecting and data processing; displaying and analyzing results; saving the results in a database in the form of data and diagrams; and reading and/or displaying analysis results via the "show result" interface option.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed is:

1. An apparatus for measurement of floating body posture of a person wearing a life jacket, comprising a backpack frame having a plurality of reference points;

an image collecting system; and an image processing system;

wherein said image collecting system collects image sequence information of the person wearing the life jacket via the reference points;

said image processing system processes said image sequence information, so as to obtain a movement process of the person and quasi-static parameters thereof.

2. The system of claim 1, wherein said image collecting system comprises a pair of cameras; and a pair of image collecting cards connected to said cameras via a pair of data lines.

3. The system of claim 2, wherein said backpack frame is located in an overlapping view field of said cameras.

4. The system of claim 1, wherein said image processing system comprises software for performing image processing; and a computer.

5. The system of claim 1, wherein said backpack frame comprises a plurality of bellows, a plurality of supporting plates, a plurality of reference points, a shoulder armor plate, a plurality of aluminum pipes, a haunch armor plate, a plurality of steel bars, a plurality of rivets, a waistband, a plurality of welding spot, a first connector and a second connector.

6. The system of claim 5, wherein said bellows are jointly connected to the aluminum pipes via said shoulder armor plate.

7. The system of claim 5, wherein said haunch armor plate is connected to said steel bar via said rivet.

8. The system of claim 5, wherein said aluminum pipe is connected to said bellows via said first connector.

9. The system of claim 5, wherein said aluminum pipe is connected to said supporting plates and said reference point via said second connector.

10. The system of claim 5, wherein a surface of said supporting plate is coated with low-reflectivity materials.

11. The system of claim 5, wherein said supporting plate is fixed to said first connector via a screw thread.

12. The system of claim 5, wherein said reference point is fixed to said first connector with glue.

13. The system of claim 5, wherein said shoulder armor plate operates to fix said backpack frame to a shoulder of the person wearing the life jacket.

* * * * *